United States Patent [19]

Shimogawara et al.

[11] Patent Number: 4,812,065

[45] Date of Patent: Mar. 14, 1989

[54] CUT SHEET FEEDING MECHANISM

[75] Inventors: Jun Shimogawara, Tokyo; Hironori Nakamura, Kawasaki, both of Japan

[73] Assignee: NEC Corporation, Tokyo, Japan

[21] Appl. No.: 26,335

[22] Filed: Mar. 16, 1987

[30] Foreign Application Priority Data

Mar. 14, 1986 [JP] Japan ..... 61-56443

[51] Int. Cl.[4] ..... B41J 13/10

[52] U.S. Cl. ..... 400/624; 400/629; 74/810; 74/435

[58] Field of Search ..... 400/625, 624, 629; 74/810, 384, 435

[56] References Cited

U.S. PATENT DOCUMENTS

| | | | |
|---|---|---|---|
| 3,661,339 | 5/1972 | Shimizn | 74/435 |
| 3,943,786 | 3/1976 | Mills | 74/384 |
| 4,347,919 | 9/1982 | Maeda | 74/435 |
| 4,509,734 | 4/1985 | Rutishanser | 400/625 |
| 4,523,869 | 6/1985 | Martin | 400/629 |
| 4,565,462 | 1/1986 | Yamamoto et al. | 400/625 |
| 4,630,951 | 12/1986 | Nii | 74/810 |
| 4,664,546 | 5/1987 | Runzi | 400/629 |
| 4,669,333 | 6/1987 | Matsuda et al. | 74/810 |

*Primary Examiner*—William Pieprz

*Attorney, Agent, or Firm*—Sughrue, Mion, Zinn, Macpeak & Seas

[57] ABSTRACT

A cut sheet feeding mechanism for feeding a cut sheet from a sheet hopper to a platen roller which is rotated in a forward direction to further feed the cut sheet to a printer. The mechanism includes a pick-up roller for picking up a cut sheet from a sheet hopper by rotating in a forward rotary direction and a transmission for transmitting the rotary force of the platen roller to a pick-up roller in a manner such that the pick-up roller also rotates in the forward direction. The transmission includes a disabling device for disabling the transmission after the pick-up roller has fed the cut sheet from the hopper by a predetermined amount.

3 Claims, 3 Drawing Sheets

FIG. 2A
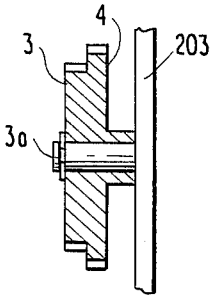
FIG. 2B
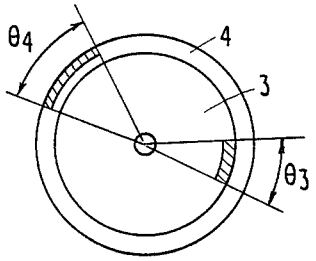
FIG. 3
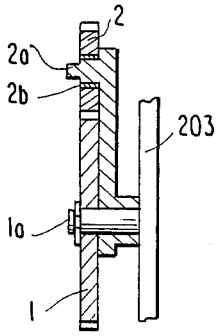
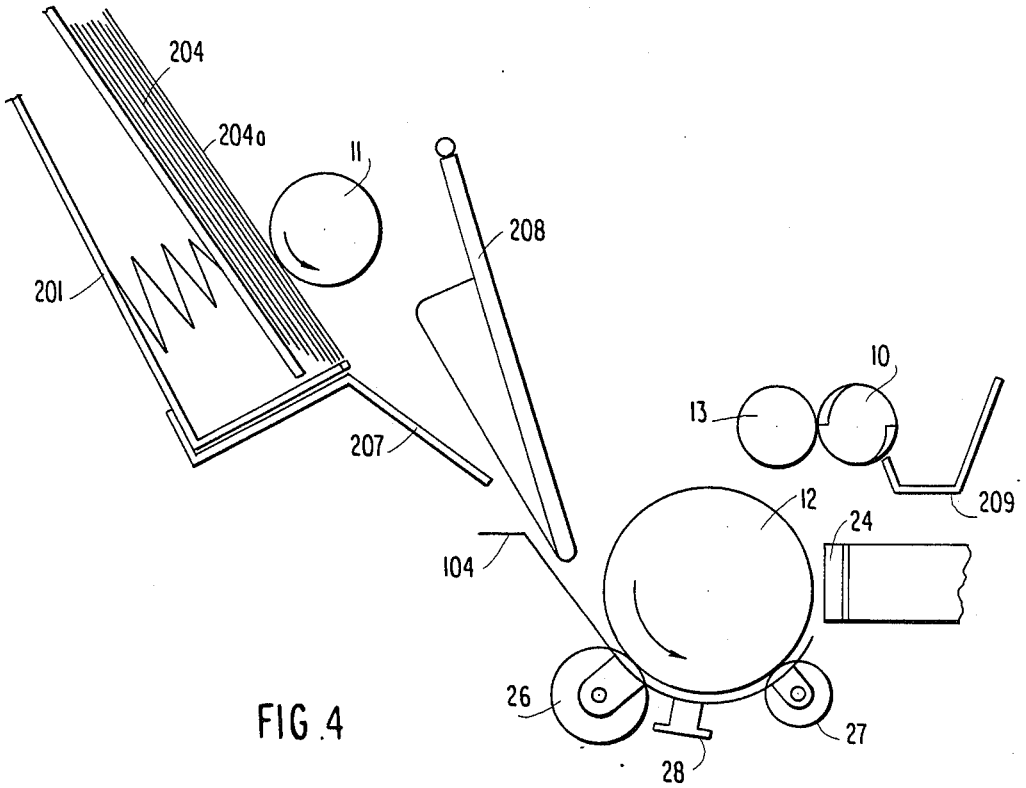
FIG. 4

CUT SHEET FEEDING MECHANISM

BACKGROUND OF THE INVENTION

The present invention relates to a cut sheet feeding mechanism for use in a printer, typewriter or the like, and more particularly to a cut sheet feeding mechanism for separating a cut sheet from stacked cut sheets in a sheet hopper and for feeding it to a printing position of a printing apparatus.

Such a conventional sheet feeding mechanism is disclosed in U.S. Pat. No. 4,248,415 patented to Steinhilber on Feb. 3, 1981. This mechanism includes a pick-up roller for picking up a cut sheet from a sheet hopper and for feeding it to a platen roller on which the printing operation is carried out. The platen roller is connected to a drive motor and rotated by the drive motor in a first direction to feed the cut sheet in cooperation with a pressure roller urged to a surface of the platen roller during the printing operation. The pick-up roller also obtains its rotary force from the drive motor thru a transmission which includes gears, a belt and a one-way clutch.

In operation, first, the drive motor enables the platen roller to rotate in a second direction reverse to the first direction in order to pick up a cut sheet from the sheet hopper. The transmission transmits the rotary force to the pick-up roller so as to rotate the pick-up roller in the first direction. Thus, the pick-up roller picks up the uppermost sheet in the sheet hopper and feeds it to a contact portion between the platen roller and the pressure roller. After the leading edge of the cut sheet has been fed to and pressed against the contact portion, the drive motor then rotates in the reverse direction, enabling the platen roller to rotate in the first rotary direction to feed the cut sheet to the printing position. The one-way clutch prevents the transmission of the rotary force in this direction to the pick-up roller. Accordingly, the rotation of the pick-up roller is stopped so as not to interrupt the feeding of the cut sheet by the platen roller and the pressure roller.

In the conventional mechanism, the leading edge of the cut sheet is pressed by the pick-up roller against the contact portion where the pressure roller is urged against the platen roller, which rotates in the second direction, before the platen roller feeds the cut sheet to the printing position. Accordingly, the leading edge of the cut sheet is apt to be bent by the reverse feeding force of the platen roller, and moreover, forced out of the contact portion.

SUMMARY OF THE INVENTION

Therefore, an object of the present invention is to provide a improved cut sheet feeding mechanism in which a platen roller and a pressure roller do not impart a reverse feeding force to the leading edge of a cut sheet when a pick-up roller feeds the leading portion of the cut sheet to the contact portion between the platen roller and the pressure roller.

Another object of the present invention is to provide a cut sheet feeding mechanism in which a pick-up roller is rotated to pick up a cut sheet by the rotation of the platen roller in the direction feeding the cut sheet to a printing position.

According to the present invention, the cut sheet feeding mechanism includes a transmission means for transmitting the rotary force of a platen roller to a pick-up roller such that the pick-up roller rotates in the same direction as the platen roller, and means for disabling the transmitting operation after the pick-up roller feeds the cut sheet by a predetermined length.

BRIEF DESCRIPTION OF THE DRAWINGS

FIGS. 2*a* and 2*b* show views of the notched gears used in the cut sheet feeding mechanism shown in FIG. 1;

FIG. 3 shows a planet gear used in the cut sheet feeding mechanism shown in FIG. 1;

FIG. 4 is a cross-sectional view showing a sheet feeding path of a cut sheet feeding unit and a printer unit shown in FIG. 1.

DESCRIPTION OF THE PREFERRED EMBODIMENT

Figure 1:
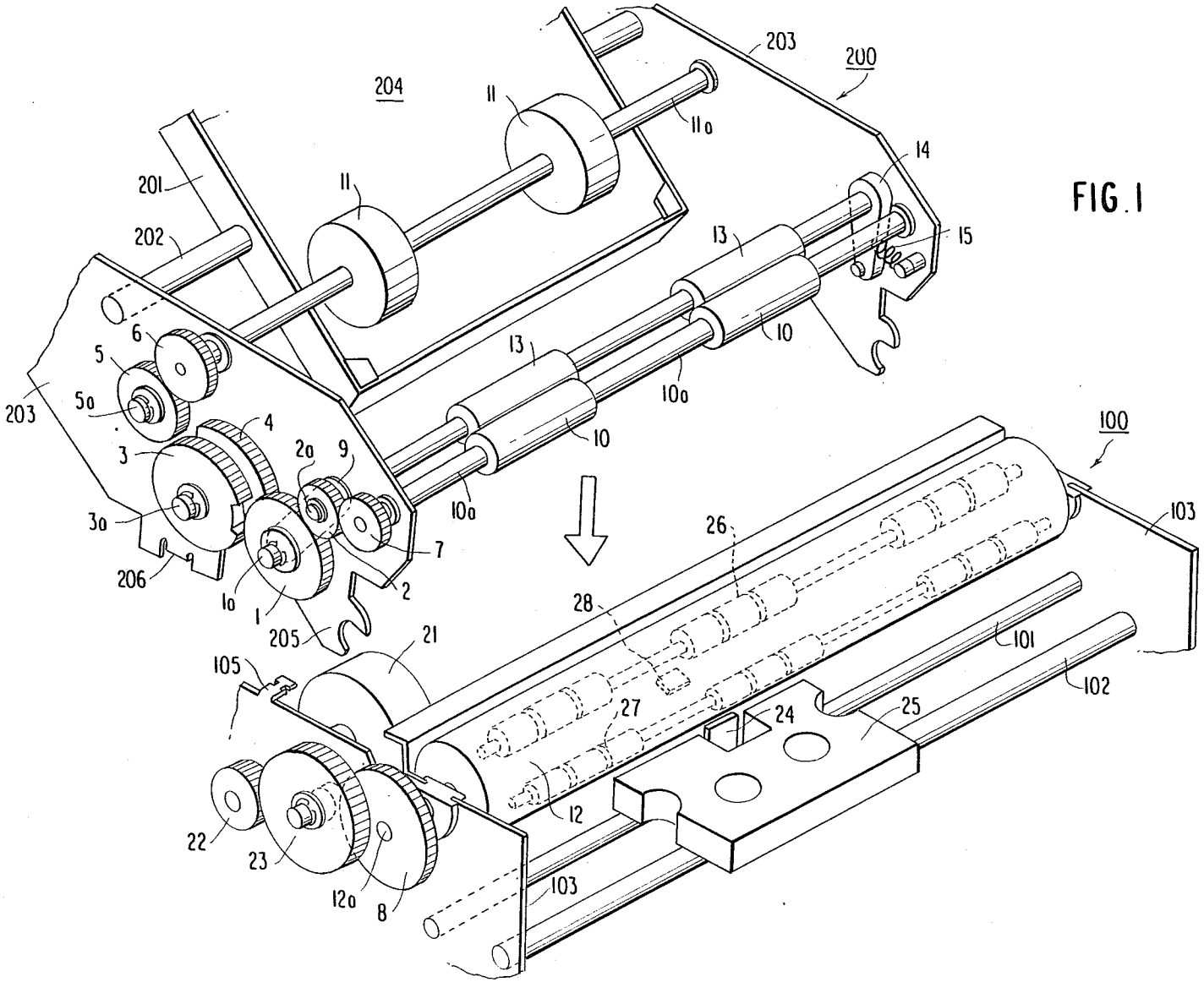
FIG. 1 is a perspective view of a cut sheet feeding mechanism according to an embodiment of the present invention.

FIG. 1 shows an embodiment of the present invention which comprises a print unit 100 and a cut sheet feeding unit 200. The cut sheet feeding unit 200 includes a sheet hopper 201 supported by a pair of shafts 202 to a frame 203. The sheet hopper 201 stores a plurality of cut sheets 204 stacked therein. Pick-up rollers 11 are rotatably provided above the sheet hopper 201 by a shaft 11*a* so as to be contacted with the uppermost sheet of the cut sheets 204 in the sheet hopper 201. One end of the shaft 11a is provided with a pick-up roller gear 6 which engages an idler gear 5. The idler gear 5 is rotatably supported on the frame 203 via a shaft 5*a* and engageable with a notched gear 4. The notched gear 4 is integrally formed with an another notched gear 3 which has smaller diameter than the notched gear 4, as also shown in FIGS. 2A and 2B. The notched gears 3 and 4 are coaxial with each other and are rotatably provided on the frame 203 via a shaft 3*a*. Sectorial angles $\theta_3$ and $\theta_4$ of notch portions of the notched gears 3 and 4 are 31° and 49°, respectively. When the notch portion of the gear 4 is opposite the idler gear 5, the gears 4 and 5 do not engage with each other.

An idler gear 1 is rotatably provided on the frame 203 via a shaft 1*a* and is engageable with the notched gear 3. As also shown in FIG. 3, an arm 9 is rotatably supported around the shaft 1*a* at its one end. The other end of the arm 9 has a shaft 2*a* around which a planet gear 2 is rotatably provided such that the planet gear 2 engages the idler gear 1. Frictional material such as rubber 2*b* is attached between the planet gear 2 and the shaft 2*a* so that the rotational friction between the planet gear 2 and the shaft 2*a* is greater than that between the one end of the arm 9 and the shaft 1*a*. Accordingly, the planet gear 2 can be rotated around the shaft 2*a* by the idler gear 1 only when the arm 9 is prevented from rotation around the shaft 1*a*.

The planet gear 2 can engage either the notched gear 3 or the eject roller gear 7 by the rotation of the arm 9 around the shaft 1*a*. The eject roller gear 7 is connected to a roller shaft 10*a* which is rotatably supported by the frame 203. Eject rollers 10 are provided around the shaft 10*a* for ejecting a printed sheet from the printer unit 100 in cooperation with pressure rollers 13. A shaft 13*a* of the pressure rollers 13 is rotatably supported at both ends by levers 14 (only one is illustrated) which are biased by springs 15 so that the pressure rollers 13 are urged against the eject rollers 10.

The printer unit 100 includes a thermal head 24 and an inked ribbon cartridge 25 which both are slidably supported by guide shafts 101 and 102. A platen roller 12 is rotatably supported at both ends on a frame 103 so as to oppose the thermal head 24. Under the platen roller 12, pressure rollers 26 and 27 are rotatably provided such that they are urged to the surface of the platen 12 by a known manner as described in U.S. pat. appln. Ser. No. 748,643 filed June 25, 1985, now issued as U.S. Pat. No. 4,655,626. Additionally, a sheet guide 104 is provided for guiding the cut sheet supplied from the sheet feeding unit 200 to the position between the platen roller 12 and the pressure rollers 26. A sensor 28 is also provided under the platen roller 12 for detecting a leading edge of the supplied cut sheet.

One end of shaft 12*a* of the platen roller 12 is provided with a platen gear 8 to which a rotary force is supplied by a drive motor 21 transmitted thru a gear 22 connected to the drive motor 21 and an idler gear 23. When the drive motor 21 rotates in the counterclockwise direction, the platen roller 12 is rotated in the same direction to feed the cut sheet to the printing position where the thermal head 24 is located.

The cut sheet feeding unit 200 is attached to the printer unit 100 by engaging connector 205 with platen shaft 12*a* and connector 206 with acceptor 105. When the cut sheet feeding unit 200 is attached, the idler gear 1 engages the platen gear 8, and the rotary force of the drive motor 21 is transmitted to the idler gear 1.

The sheet feeding path from the cut sheet feeding unit 200 to the printer unit 100 will be described with reference to FIG. 4. The uppermost sheet 204*a* is separated from the stacked sheets 204 and fed downward to a sheet guide 207 by the rotation of the pick-up roller 11 in the counterclockwise direction. The sheet 204*a* is further fed to the sheet guide 104 of the printer unit 100 by the guidance of a sheet guide 208. Then, the leading edge of the cut sheet 204*a* reaches the position where the pressure roller 26 is in contact with the platen roller 12 and is inserted therebetween. As the platen roller 12 is rotated in the counterclockwise direction, the cut sheet 204*a* is further fed by the platen roller 12 and the pressure roller 26. At this time, the feeding force of the pick-up roller 11 is no longer necessary. Moreover, it should be noted that the pick-up roller 11 must be stopped after the trailing edge of the sheet 204*a* has passed through the pick-up roller 11 to prevent the pick-up roller 11 from feeding the next uppermost sheet.

After the leading edge of the cut sheet 204*a* is detected by the sensor 28, the platen roller 12 is further rotated in the counterclockwise direction by a predetermined feeding amount to locate the first print line of the sheet 204*a* in front of the head 24. The head 24 carries out a printing operation line by line on the sheet 204*a*, as the platen roller 12 intermittently feeds the sheet 204*a*. Then, the leading edge of the sheet 204*a* is inserted between the eject roller 10 and the pressure roller 13 and fed thereby out of the printer unit 100. The printed sheet 204*a* is stacked in a sheet stacker 209 by the eject roller 10. The sheet guides 207 and 208 and the sheet stacker 209 are provided on the cut sheet feeding unit 200, however, they are omitted in FIG. 1 for the purpose of illustration.

Figure 5:
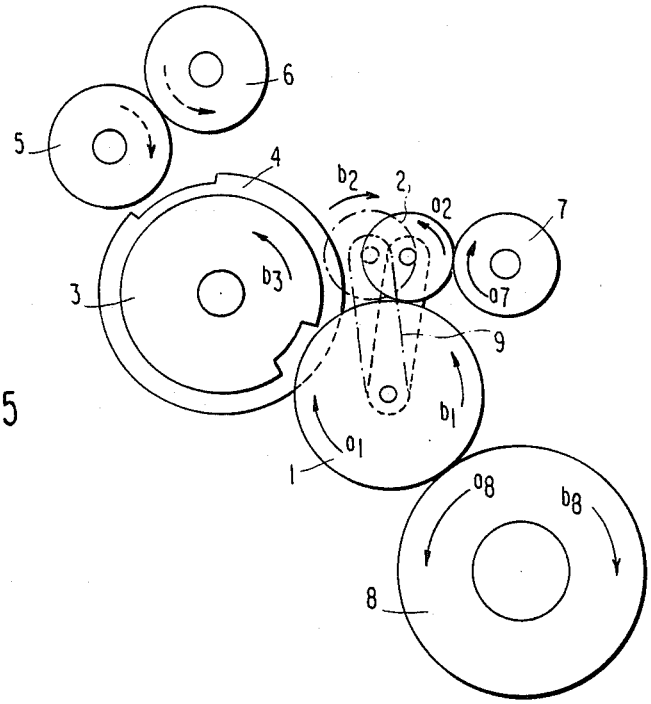
FIGS. 5 and 6 illustrate the operation of the cut sheet feeding mechanism shown in FIG. 1.
Figure 6:
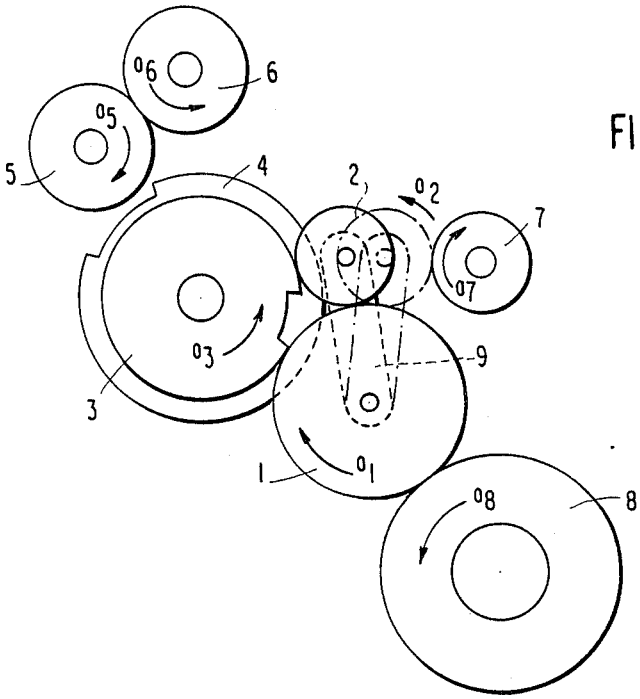

The operation of the cut sheet feeding mechanism will be now described in reference to FIGS. 5 and 6. Initially, the planet gear 2 engages the eject roller gear 7 while the idler gears 1 and 5 are disengaged from the notched gears 3 and 4, respectively, as shown in FIG. 5. The numbers of teeth of the gears 1, 2, 3, 4, 5, 6, and 8 are "55", "30", "58" (but minus "5" due to the notched portion), "58" (but minus "8" due to the notched portion), "30", "35" and "76", respectively.

Next, the drive motor 21 enables the platen gear 8 to rotate in the direction of arrow $b_8$ by an angle of 21°. Then, the idle roller 1 is rotated in the direction of arrow $b_1$ by an angle of 29° ($=76/55\times21°$) so that the arm 9 is rotated around the shaft 1*a* in the counterclockwise direction by an angle of 29° as illustrated by the one-dot and dashed line in FIG. 5. Thus, the planet gear 2 engages the notched gear 3. The platen gear 8 is further rotated in the direction of arrow $b_8$ by an angle of 15°. Then, the planet gear 2 is rotated in the direction of arrow $b_2$ thru the idler gear 1 since the arm 9 cannot be further rotated in the counterclockwise direction. Due to the rotation of the planet gear 2, the notched gears 3 and 4 are rotated in the direction of arrow $b_3$ by an angle of about 18°. Thus, the notched gear 3 comes to engage with the idler gear 1 as shown in FIG. 6. Until the above operation, the pick-up roller gear 6 is not rotated, and therefore the pick-up roller 11 does not feed the cut sheet 402.

Next, the drive motor 21 rotates the platen gear 8 in the reverse direction, i.e. in, the direction of arrow $a_8$. This causes the idler roller 1 to rotate in the direction of arrow $a_1$ and the arm 9 to rotate in the clockwise direction as illustrated in the one-dot and dashed line in FIG. 6. Thus, the planet gear 2 disengages the notched gear 3 and engages the eject roller gear 7. The platen gear 8 is further rotated in the direction of arrow $a_8$ to rotate the idler gear 1 in the direction of arrow $a_1$. Thus, the rotation is transmitted to the notched gear 3, and the gears 3 and 4 are rotated in the direction of arrow $a_3$. Then, the notched gear 4 engages the idler gear 5 to rotate it in the direction of arrow $a_5$, and therefore, the pick-up gear 6 is rotated in the direction of arrow $a_6$. Accordingly, the pick-up roller 11 is rotated to pick up the uppermost cut sheet 402*a* from the sheet hopper 201 and to feed it to the printer unit 100. It should be noted that the rotation of the platen gear 8 is transmitted to the pick-up roller gear 6 such that they rotate in the same direction.

When the notched gear 3 is rotated by one rotation, the notched portions of the gears 3 and 4 come to be opposite the idler gears 1 and 5, respectively, and return to the initial state (FIG. 5). In other words, the notched gears 3 and 4 disengage the idler gears 1 and 5, respectively. By one rotation of the notched gear 4, the pick-up roller 11 feeds the cut sheet 204*a* to the position where the leading edge of the sheet 204*a* is inserted between the platen roller 12 and the pressure rollers 26 and the trailing portion of the sheet 204 is still in contact with the pick-up roller 11. Since the platen roller 12 is rotated in the direction of arrow $a_8$, which is the direction feeding the sheet to the printing position, when the leading edge of the sheet reaches the position between the platen roller 12 and the pressure rollers 26, the leading edge of the sheet 204*a* is not subject to a reverse feeding force.

Finally, the cut sheet 204*a* is fed by the platen roller 12 and the pressure rollers 26 and 27. The drive motor 21 further rotates the platen gear 8 in the direction $a_8$ as shown in FIG. 5, in order to rotate the platen roller 12 for the printing operation. The rotation of the idler gear 1 enables the planet gear 2 to rotate in the direction of arrow $a_2$, which causes the eject roller gear 7 to rotate in the direction of arrow $a_7$. Incidentally, the pick-up roller 11 is rotated following the feeding operation of the platen roller 12 since it contacts the trailing portion of the sheet 204*a*. However, the rotation of the idler gear 5 is not transmitted to the notched gear 4 owing to the notch portion.

As described above, the cut sheet feeding mechanism according to the present invention can feed the cut sheet from the sheet hopper to the print unit with high reliability.

What is claimed is:

1. A cut sheet feeding mechanism for feeding a cut sheet from a sheet hopper (201) to a platen roller (12) provided on a platen roller shaft (12*a*) connected to a drive motor (21), said platen roller being rotated by said drive motor in a forward rotary direction to further feed said cut sheet to a printing position of a printer, said cut sheet feeding mechanism comprising:

a pick-up roller shaft (11*a*);

a pick-up roller (11), provided on said pick-up roller shaft, which rotates in said forward rotary direction to pick up said cut sheet from stacked cut sheets in said sheet hopper;

a platen gear (8) connected to said platen roller shaft;

an idler gear shaft (1*a*);

a first idler gear (1) provided on said idler gear shaft and engaged with said platen gear;

a first notched gear (3) including a first gear portion and a first notched portion, said first notched gear being engaged with said first idler gear (1) at said first gear portion and being disengaged with said first idler gear at said first notched portion;

a planet gear (2) rotatably supported by an arm (9) such that said planet gear is engaged with said first idler gear, said arm being rotatably supported by said idler gear shaft; and a pick-up roller gear (6) connected to said pick-up roller shaft (11*a*), said pick-up roller gear being associated with said first notched gear (3);

said drive motor (21) driving said platen gear (8) to rotate in a reverse rotary direction, opposite said forward rotary direction, when said first notched portion of said first notched gear is opposed to said first idler gear so as to rotate said arm around said idler gear shaft to engage said planet gear with said first gear portion of said first notched gear, so that said first notched gear is rotated in said forward rotary direction by said platen gear through said first idler gear and said planet gear, whereby said first gear portion of said first notched gear is engaged with said first idler gear, said drive motor subsequently driving said platen gear to rotate in said forward rotary direction so as to rotate said arm around said idler gear shaft to separate said planet gear from said first idler gear so that said first notched gear is further rotated in said forward rotary direction by said platen gear through said first idler gear, whereby said pick-up roller gear is rotated in said forward rotary direction by said first notched gear until said first notched portion of said first notched gear is opposed to said first idler gear, a rotary force of said platen roller in said forward direction being transmitted to said pick-up roller in a manner such that said pick-up roller also rotates in said forward direction until said pick-up roller has fed said cut sheet from said sheet hopper by a predetermined length.

2. The cut sheet feeding mechanism as claimed in claim 1, further comprising a second notched gear (4) coaxial with said first notched gear and rotating together with said first notched gear, said second notched gear including a second gear portion and a second notched portion, and a second idler gear (5) engaged with said pick-up roller gear, said second second idler gear being engaged with said second gear portion of said second notched gear when said first idler gear is engaged with said first gear portion of said first notched gear and being opposed to said second notched portion of said second notched gear when said first idler gear is opposed to said first notched portion of said first notched gear.

3. The cut sheet feeding mechanism as claimed in claim 1, further comprising an eject roller shaft (10*a*), an eject roller (10), provided on said eject roller shaft, for feeding said cut sheet out of said printer, and further comprising an eject roller gear (7) provided on said eject roller shaft, said eject roller gear being engaged with said planet gear (2) when said planet gear is separated from said first idler gear so that said rotary force of said platen roller is also transmitted to said eject roller.

* * * * *